United States Patent [19]

Schulthess

[11] 4,307,543

[45] Dec. 29, 1981

[54] DOOR

[75] Inventor: Hans Schulthess, Klingnau, Switzerland

[73] Assignee: Novopan Aktiengesellschaft, Klingnau, Switzerland

[21] Appl. No.: 75,936

[22] Filed: Sep. 17, 1979

Related U.S. Application Data

[63] Continuation of Ser. No. 962,583, Nov. 21, 1978, abandoned.

[30] Foreign Application Priority Data

Nov. 22, 1977 [CH] Switzerland ..... 14303/77

[51] Int. Cl.[3] ..... E06B 3/00

[52] U.S. Cl. ..... 49/501; 49/504; 52/232

[58] Field of Search ..... 49/383, 501, 504; 52/232

[56] References Cited

U.S. PATENT DOCUMENTS 3,964,214 6/1976 Wendt ..... 49/504 X

FOREIGN PATENT DOCUMENTS 2607248 2/1976 Fed. Rep. of Germany ..... 49/501

569181 11/1975 Switzerland ..... 49/501

*Primary Examiner*—Kenneth Downey

*Attorney, Agent, or Firm*—Ladas & Parry

[57] ABSTRACT

A door is disclosed which is primarily intended for application as a door being resistant to fire.

This door having a more particularly metal frame, whereby disposed on the door frame is a material which foams under the effect of an increased temperature. Said material is applied in the form of a strip in the rebate of the door frame. Further, said material can be protected by means of a cover being wider than the strip of said foamable material, whereby the projecting portions of the cover bear tightly against the frame. One projecting part of the cover is disposed in one of the rooms, and the other projecting portion in the other of the rooms separated from one another by the door.

8 Claims, 2 Drawing Figures

DOOR

This is a continuation of co-pending application Ser. No. 962,583 filed Nov. 21, 1978 and now abandoned.

The invention relates to a door having a more particularly metal frame.

Of course demands made on doors include their resistance to fire. The resistance to fire of the door leaf and door frame are not the only important aspects, but also the matter of how tightly the door leaf fits in the door frame. If a fire breaks out, the size of the gap between the door leaf and the door frame is very important, for a number of reasons. Several steps have therefore already been taken to close such gap as tightly as possible, at the latest after a fire has broken out. We shall mention only one of these steps here, namely that of providing a foaming agent on the narrow side of the door leaf, opposite the door frame. The foaming agent is caused to foam by the heat produced by the fire and fills the gap. The door leaf is often made of wood or some similar material of low thermal conduction. The foaming agent therefore usually reached the foaming temperature only when the edge of the door leaf was already on fire, and in the majority of cases this was too late.

It is an object of the invention to provide a door in which the gap between the door leaf and the door frame is filled as quickly as possible. To this end in the door according to the invention disposed on the door frame is a material which foams under the effect of an increased temperature.

Figure 2:
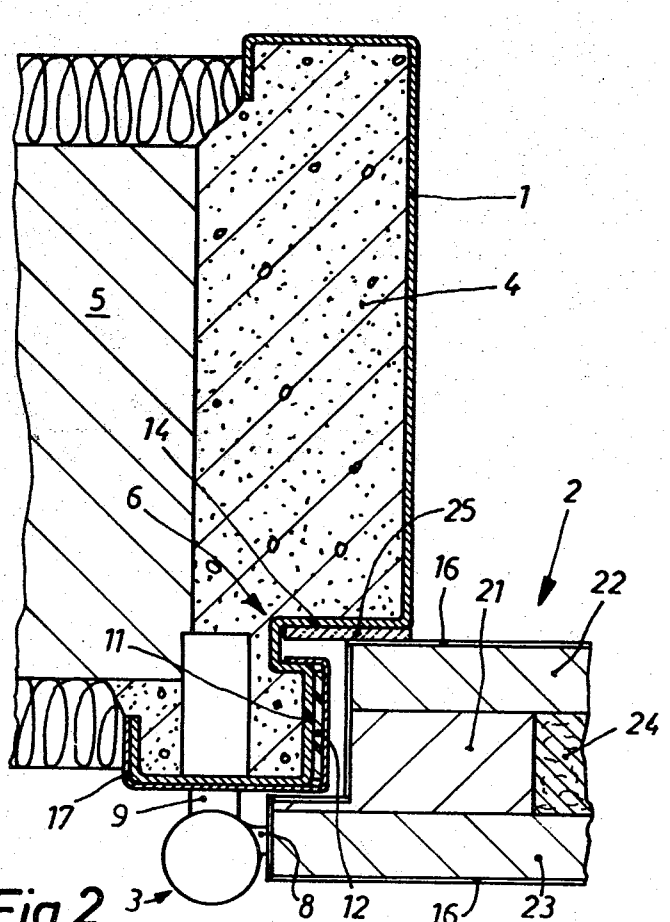
Figure 1:
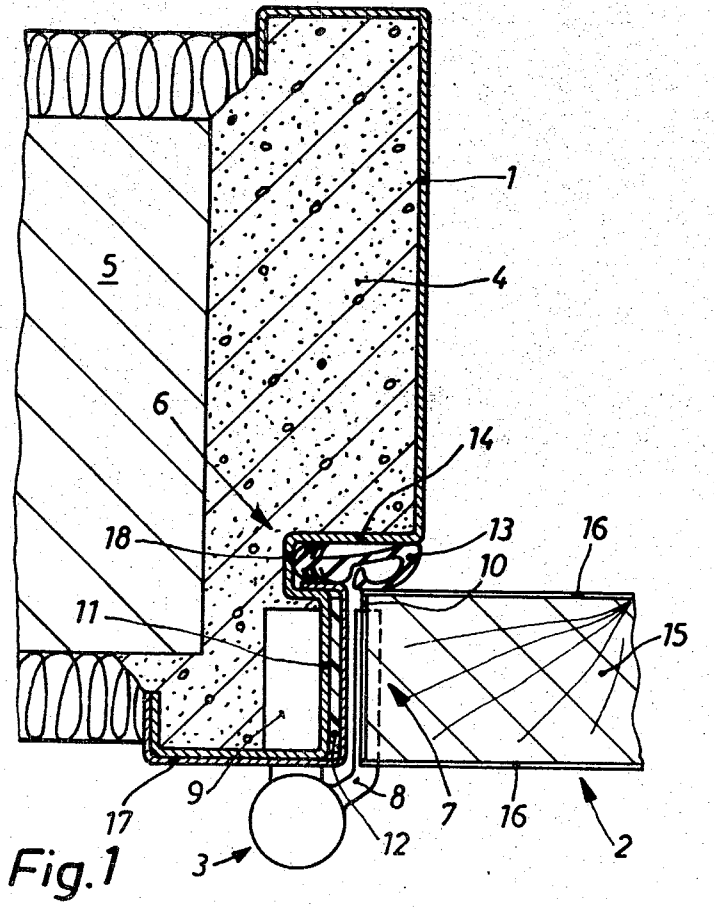

Embodiments of the invention will now be described in greater detail with reference to the accompanying drawings, wherein:

FIG. 1 is a horizontal cross-section through the first embodiment of the invention, and FIG. 2 is a horizontal cross-section through a second embodiment of the invention.

Referring to FIG. 1, a door is so constructed that it will stand up to fire during a 30 minute test. The door has a steel frame 10 in which a leaf 2 is pivotally attached by means of hinge plates 3. The frame 1 has a cross-section such that it partially encloses masonry of concrete, artificial stone or the like, which is adjoined by a wall 5 in which the door is inserted. The section of the frame 1 also has a rebate 6 in which the facing edge portion 7 of the door leaf 2 rests. Edge portion 7 of door leaf 2 is connected to one of the arms 8 of the hinge plate 3. The other arm 9 of the hinge plate 3 is let into a door frame 4. Of course a gap is left between that flank 11 of the rebate 6 which is opposite narrow side 10 of door leaf 2 and the narrow side 10, and if a fire breaks out such gap must be sealed. This is done by means of a material applied in the form of a strip 10 to flank 11 of rebate 6. The material can be, for instance, an aqueous sodium silicate commercially available under the name "Palusol". If fire breaks out on one side of the door leaf 2, as a result the metal frame on one side or the other becomes heated relatively quickly. The thermal conduction taking place in the metal frame 1 soon heats the Palusol to above 200° C., and when that temperature is exceeded the material begins to foam. The resulting foam then fills the gap between rebate 6 and edge portion 7 of the door leaf 2, thus separating the two rooms sealing-tight from one another, as required.

In this embodiment of the invention the gap between the frame and the door leaf can normally be sealed by means of a rubber seal 13. The rubber seal 13 comprises a strip of suitable suction which extends all along the frame 1. The base portion of the strip 13 is disposed in an indentation 18 in the door frame 1. The seal is therefore mainly provided between the other flank 14 of rebate 6 and the front area of edge portion 7 of door leaf 2 which is disposed opposite the flank 14.

In this embodiment the door leaf 2 comprises a chipboard panel 15 commercially available under the name "Novopan". The chipboard panel 15 is given a veneer 16 on both sides, which may be varnished or painted. If the door is to act as an outside door, the chipboard panel 15 can be coated with aluminium, so as substantially to prevent the penetration of moisture into the panel 15.

To prevent the foaming agent 12 on the door frame 1 from getting damaged in any way, the strip 12 has a cover 17 in the form of a PVC section. However, the strip 12 can also be packed in an aluminium foil to protect the strip against moisture. If fire breaks out, the cover 17 melts off within 1 to 3 minutes and the gap between the frame 1 and the door leaf 2 can fill with the foam. The cover 17, having the shape of a section enclosing the strip-side frame portion, extends, just by the strip 12 of foam material, all along the frame 1. The cover strip 17 which, unlike the strip 12 of foaming agent, is angular, is nevertheless wider than the strip 12. The projecting portions of the strip-shaped cover 17 bear sealing tight against those portions of the metal door frame 12 which adjoin the strip 12. In this way an optimum hold of the cover 17 on the door frame 1 is achieved, while at the same time optimum heat transfer to the strip of foaming agent is ensured.

FIG. 2 shows a second embodiment of the invention in which the door is designed to stand up to a 90 minute fire test. To improve the resistivity of this door to fire, the cover 7 is of sheet aluminium. The purpose of using sheet aluminium is to determine a suitable moment for the melting of the cover 17 during the 90 minute fire test, when the foaming process of the strip 12 starts, whereafter the clearance between the door frame and the door leaf is filled with foam.

The door leaf 2 has the frame 21 made of "Vermipan" (registered Trade Mark), a material which is a mixture of vermiculite and a binder. Attached to both sides of the frame 21 are sheets 22, 23 of "Vermipan". The cavity between the sheets 22, 23 laterally bounded by the frame 21 can either be left unobstructed or, as shown in FIG. 2, be filled with rock wool. The door leaf 2 can again either have a varnished or painted veneer 16 or aluminim panels. Since in that case the door leaf 2 is thicker than in the preceding embodiment, the hinge plate 3 can be applied in a simpler manner. The first arm 8 of the hinge plate 3 can be let into the outer sheet 23, and the other arm 9 of the hinge plate 3 can be attached to the door frame 1 even at a distance from the first flank 11 of the rebate 6.

A second essential step in this embodiment is that a strip of a non-flammable material, for instance, asbestos, is disposed on the second flank of the rebate 6. In that case the front side of the asbestos strip 25 bears tightly against the surface of the other "Vermipan" sheet 22. Normally the asbestos strip 25 ensures that the rooms separated from one another by the wall 5 are sealed in relation to one another. If fire breaks out the asbestos strip 25 retains its sealing properties, with the addition of the seal produced by the "Palusol" foam.

I claim:

1. A door for separating two rooms and comprising: